US009157680B2

(12) United States Patent
Izawa et al.

(10) Patent No.: US 9,157,680 B2
(45) Date of Patent: Oct. 13, 2015

(54) DRUM-TYPE DRYING DEVICE

(75) Inventors: Hideo Izawa, Sakura (JP); Takao Namiki, Sakura (JP); Yuuichi Yamazaki, Kashiwa (JP)

(73) Assignee: MIYAKOSHI PRINTING MACHINERY CO., LTD. (JP)

( * ) Notice: Subject to any disclaimer, the term of this patent is extended or adjusted under 35 U.S.C. 154(b) by 1036 days.

(21) Appl. No.: 13/165,909

(22) Filed: Jun. 22, 2011

(65) Prior Publication Data

US 2011/0314688 A1 Dec. 29, 2011

(30) Foreign Application Priority Data

Jun. 25, 2010 (JP) ..... 2010-145069

(51) Int. Cl.
*D06F 58/00* (2006.01)
*F26B 13/18* (2006.01)

(52) U.S. Cl.
CPC ..... *F26B 13/183* (2013.01)

(58) Field of Classification Search
CPC ..... F26B 13/18; F26B 13/183; F26B 13/10; F26B 13/102; F26B 13/103; F26B 13/104; D21F 3/0281; H05B 2213/04; H05B 3/008; H05B 3/143; D06F 58/26; D06F 58/02; B41M 7/009; B41M 7/0081; B41J 11/002; B41F 17/00; F24C 7/06; G03D 13/002
USPC ..... 34/110, 216, 266–274; 219/469, 470; 392/417, 423, 424, 430, 432, 435; 126/91 A
See application file for complete search history.

(56) References Cited

U.S. PATENT DOCUMENTS

| | | | | |
|---|---|---|---|---|
| 2003/0115770 | A1 * | 6/2003 | Harano et al. | 34/266 |
| 2004/0078995 | A1 * | 4/2004 | Forget et al. | 34/601 |

FOREIGN PATENT DOCUMENTS

| | | | | |
|---|---|---|---|---|
| GB | 949484 | | | 2/1964 |
| JP | S53-111006 | U | | 9/1978 |
| JP | S57-83397 | U | | 5/1982 |
| JP | S62-38673 | U | | 3/1987 |
| JP | 01058336 | A | * | 3/1989 |
| JP | 2001-141364 | A | | 5/2001 |
| JP | 2009-224209 | A | | 10/2009 |
| JP | 2009-270762 | A | | 11/2009 |
| WO | 01/31271 | A1 | | 5/2001 |

OTHER PUBLICATIONS

Extended European Search Report for Application No. 11171034.9-1605 / 2400245, dated Mar. 5, 2014.
Japanese Office Action, Notice of Reasons for Rejection for Japanese Application 2010-145069; Date of Mailing: Jan. 7, 2014 with English Translation.

* cited by examiner

*Primary Examiner* — Kenneth Rinehart
*Assistant Examiner* — Jason Lau
(74) *Attorney, Agent, or Firm* — Cantor Colburn LLP

(57) ABSTRACT

A drum-type drying device according to the invention includes a cylindrical drum section that is rotatably supported and rotated by winding a base material on the drum section, engaging portions that are disposed in an inner cavity of the drum section, and a heating section that includes engaged portions detachably engaged with the engaging portions.

7 Claims, 7 Drawing Sheets

DRUM-TYPE DRYING DEVICE

BACKGROUND OF THE INVENTION

1. Field of the Invention

The present invention relates to a drum-type drying device that dries a base material. Priority is claimed on Japanese Patent Application No. 2010-145069, filed Jun. 25, 2010, the content of which is incorporated herein by reference.

2. Background Art

Hitherto, a drum-type drying device has been used to dry a base material to which a liquid coating material, such as printing ink or paint, is applied. For example, a drum-type drying device disclosed in Japanese Patent Application, First Publication No. 2001-141364 is known as a drum-type drying device.

The drum-type drying device includes a drying drum (drum section) that is supported so as to be rotatable about an axis thereof, and a stationary drum that is fixed to a support shaft and disposed in the drying drum. A thin plate-like heater (heating section) is fixed to the outer peripheral surface of the stationary drum. A part of the outer periphery of the drying drum is surrounded by a convection unit. Fume covers and discharge covers are alternately disposed on the surface of the convection unit, which faces the outer peripheral surface of the drying drum, in the circumferential direction of the drying drum. A hot air blowing device, which includes an air blower and a blowing heater, is connected to the fume covers through hoses. Further, a discharge device is connected to the discharge covers through hoses.

A base material is wound on the outer peripheral surface of the drying drum and is conveyed in a longitudinal direction of the base material, so that the drying drum is rotated by the frictional force between the base material and the drying drum. In this state, the drying drum is heated by the heater of the stationary drum and at the same time hot air is blown to the base material by the hot air blowing device. Accordingly, the base material, which is wound on the outer peripheral surface of the drying drum, is dried and gas and the like generated from the base material are discharged by the discharge device. According to the above-mentioned drum-type drying device, since the heater is fixed to the stationary drum, a rotary contact member such as a slip ring does not need to be used even though the drying drum, which is rotated by the frictional force between the base material and the drying drum, is provided. That is, an electrical wiring structure is simplified.

However, in the drum-type drying device disclosed in Japanese Patent Application, First Publication No. 2001-141364, when the heater is replaced, at least the stationary drum needs to be taken out of the device and the heater fixed to the stationary drum needs to be separated. That is, a lot of effort is required for a heater replacement operation.

The invention has been made in consideration of the above-mentioned problem, and an object of the invention is to provide a drum-type drying device where a heating section can be easily attached and detached.

SUMMARY OF THE INVENTION

The invention proposes the following means in order to achieve the object.

A drum-type drying device according to the invention includes: a cylindrical drum section that is rotatably supported and rotated by winding a base material on the drum section; engaging portions that are disposed in an inner cavity of the drum section; and a heating section that includes engaged portions detachably engaged with the engaging portions.

In the drum-type drying device, the engaging portions may be a pair of engaging portions and may be disposed so as to face each other, the heating section may include a pair of the engaged portions, and the heating section may be inserted between the pair of engaging portions, so that the engaged portions are engaged with the engaging portions, respectively.

In the drum-type drying device, the engaging portions may be disposed so as to extend parallel to an axis of the drum section.

The drum-type drying device may further include a positioning section that positions the heating section in an axial direction of the drum section and fixes the heating section.

In the drum-type drying device, the engaging portions may be a pair of groove portions, and the heating section may include a plate-like member of which both end portions form the engaged portions and are engaged with the pair of engaging portions, respectively.

The drum-type drying device may further include a power supply that supplies power to the heating section, and a connection mechanism by which the heating section and the power supply are detachably and electrically connected to each other.

In the drum-type drying device, through holes, which communicate with an inner cavity of the drum section, may be formed at least one surface of an axial direction side of the drum section.

The drum-type drying device may further include a tubular member that supports the drum section so as to allow the drum section to be rotatable about the axis of the drum section, and power supply cables that electrically connect the connection mechanism to the power supply. Further, the power supply cables may be led to the outside of the drum section from an inner cavity of the drum section through an inner cavity of the tubular member.

In the drum-type drying device, the heating section may include a near-infrared heater.

As described above, according to the drum-type drying device of the invention, it may be possible to easily attach and detach the heating section.

DETAILED DESCRIPTION OF THE INVENTION (First Embodiment)

A drum-type drying device according to an embodiment of the invention will be described below with reference to FIGS. 1 to 6. The drum-type drying device is for drying an elongated base material to which a water-based liquid coating material, such as printing ink, paint, or a sealant is applied. The drum-type drying device is suitably used for, for example, an inkjet printing machine, an electrophotographic printing machine, an offset printing machine, an inkjet water-based paste coating machine, and the like.

Figure 1:
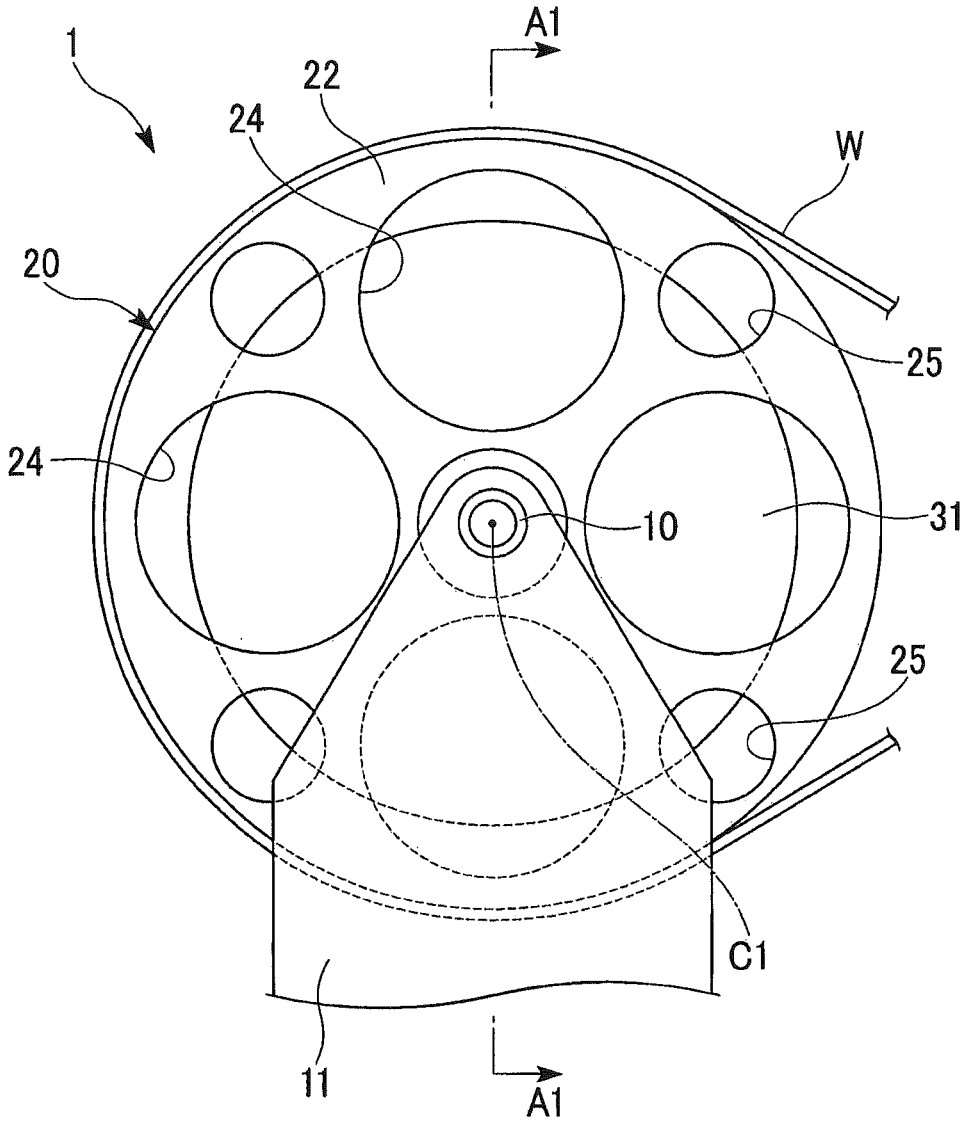
FIG. 1 is a front view of a drum-type drying device according to a first embodiment of the invention.
Figure 2:
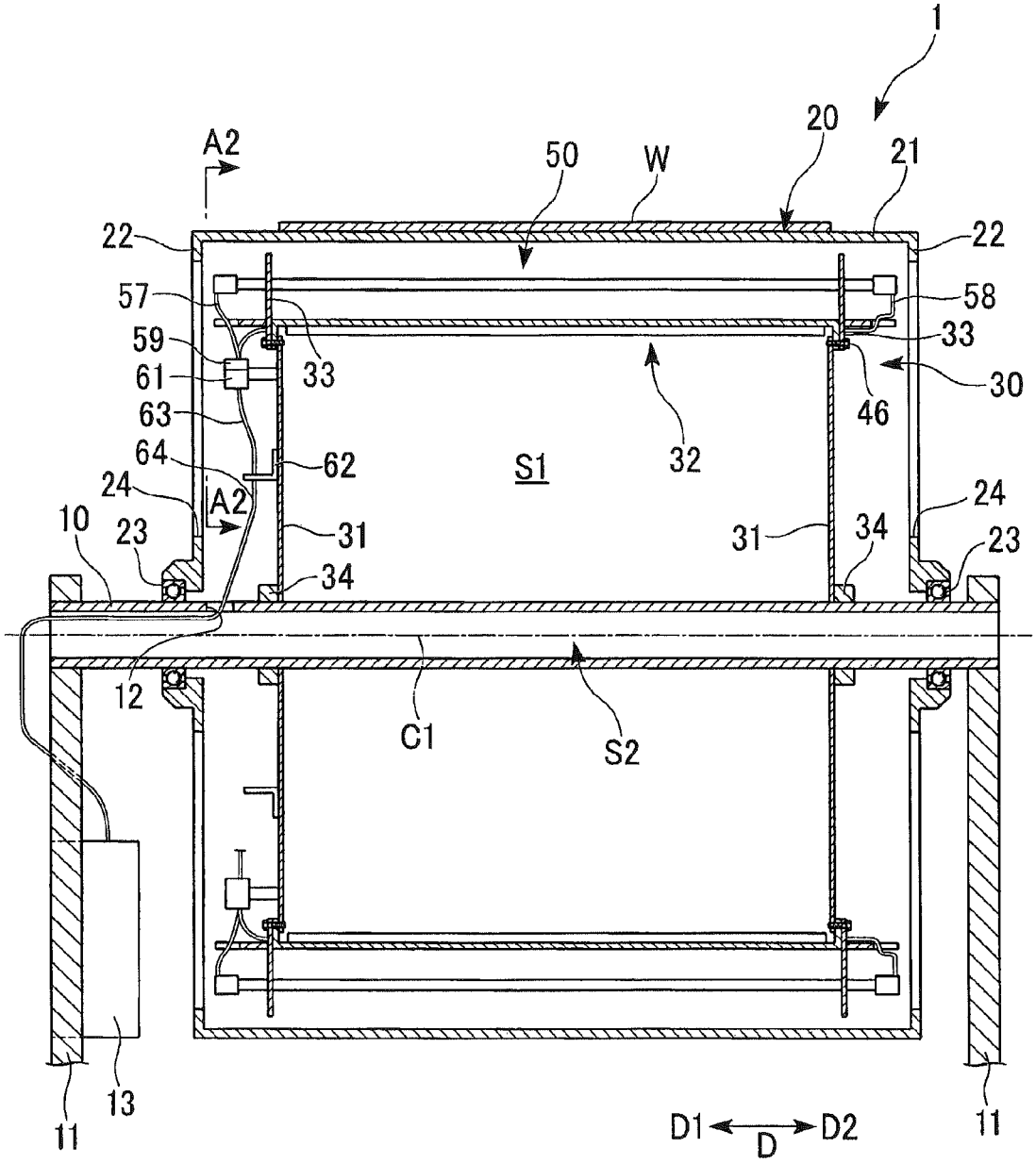
FIG. 2 is a cross-sectional view taken along a line A1-A1 of FIG. 1.

As shown in FIGS. 1 and 2, the drum-type drying device 1 according to this embodiment includes: a drum shaft (tubular member) 10 that is formed in a tubular shape; a substantially cylindrical drying drum (drum section) 20 that is rotatably supported by the drum shaft 10; a support section 30 that is fixed to the drum shaft 10 in an inner cavity S1 of the drying drum 20; and heater units (heating sections) 50 that are detachably mounted on the support section 30.

The drum shaft 10 is disposed parallel to a substantially horizontal plane, and both end portions of the drum shaft are supported by a machine base 11. A through hole 12 through which power supply cables 64 to be described below are inserted is formed at the outer peripheral surface of the drum shaft 10. Meanwhile, a power supply 13, which supplies power to the heater units 50, is mounted on the machine base 11.

The drying drum 20 includes a tubular drum main body 21 and a pair of disk-shaped lids 22 that is disposed so as to close openings formed at both end portions of the drum main body 21. Bearings 23 are connected to openings that are formed at the central portions of the lids 22, respectively. The bearings 23 are mounted on the drum shaft 10. The drying drum 20 is supported by the drum shaft 10 and the bearing 23 so as to be rotatable about an axis C1 of the drum main body 21. A base material W such as paper to which printing ink is applied is wound on the outer peripheral surface of the drum main body 21. The base material W is pulled by a conveying unit (not shown), so as to be pressed against the outer peripheral surface of the drum main body 21 with a constant force. Further, when the base material W is conveyed in the longitudinal direction of the base material W by a conveying unit, the drying drum 20 is rotated about the axis C1 by a frictional force that acts between the base material W and the drum main body 21.

As shown in FIG. 1, four large-diameter holes (through holes) 24 are formed around the axis C1 at the same distance at the outer surface of each of the lids 22 (the surface of each of the lids corresponding to the outside in the direction of the axis C1). Small-diameter holes (through holes) 25, which have a diameter smaller than the diameter of the large-diameter hole 24, respectively, are formed at the outer surface of each of the lids 22 between the adjacent large-diameter holes 24 near the edge portion of each lid 22. The large-diameter holes 24 and the small-diameter holes 25 communicate with the inner cavity S1 of the drying drum 20. A worker can insert his or her hands or the like into the inner cavity S1 from the outside of the drying drum 20 through the large-diameter holes 24 or the small-diameter holes 25.

Figure 3:
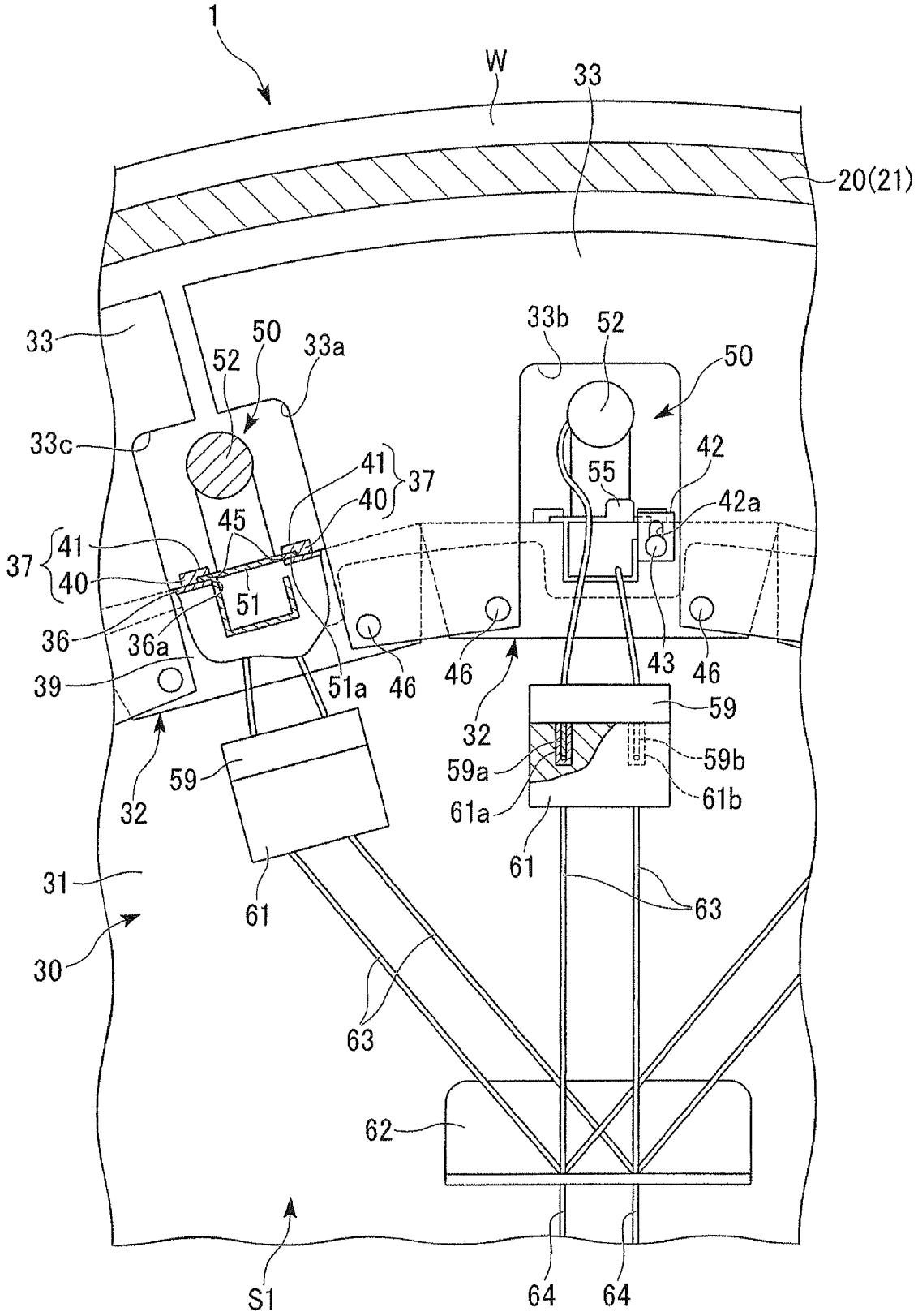
FIG. 3 is a cross-sectional view taken along a line A2-A2 of FIG. 2.

As shown in FIGS. 2 and 3, the support section 30 includes: a pair of heater supporting disks 31 that is formed in the shape of a disk and each of which is disposed apart from the other so as to be parallel to the lids 22; a plurality of mounting units 32 that is fixed to the edge portions of the pair of heater supporting disks 31; and shield plates 33 that are mounted at the edge portions of the heater supporting disks 31 so as to extend to the outside in the radial direction. The respective heater supporting disks 31 are fixed to the drum shaft 10 by fixing members 34. A plurality of threaded holes (not shown) is formed along the circumferential direction at the edge portion of each of the heater supporting disks 31. Power source-side connectors 61, of which the number corresponds to the number of the mounting units 32, are mounted in the circumferential direction on the middle portions of the heater supporting disk 31, which corresponds to the side where the power supply 13 is disposed (hereinafter, referred to as "one side D1" in an axial direction D of the drying drum 20), in the radial direction. Contacts 61*a* and 61*b* are built in each of the source-side connectors 61. Further, a plurality of supports 62 is mounted on the heater supporting disk 31 on the sides of the power source-side connectors 61 corresponding to the axis C1. Lead wires 63, which are electrically connected to the respective power source-side connectors 61, are collected at each support 62 into pluralities, and connected to the power supply cables 64.

As shown in FIG. 2, the power supply cables 64 are led to the outside of the drying drum 20 from the inner cavity S1 of the drying drum 20 through the through hole 12 of the drum shaft 10 and an inner cavity S2 of the drum shaft 10, and are electrically connected to the power supply 13.

Figure 4:
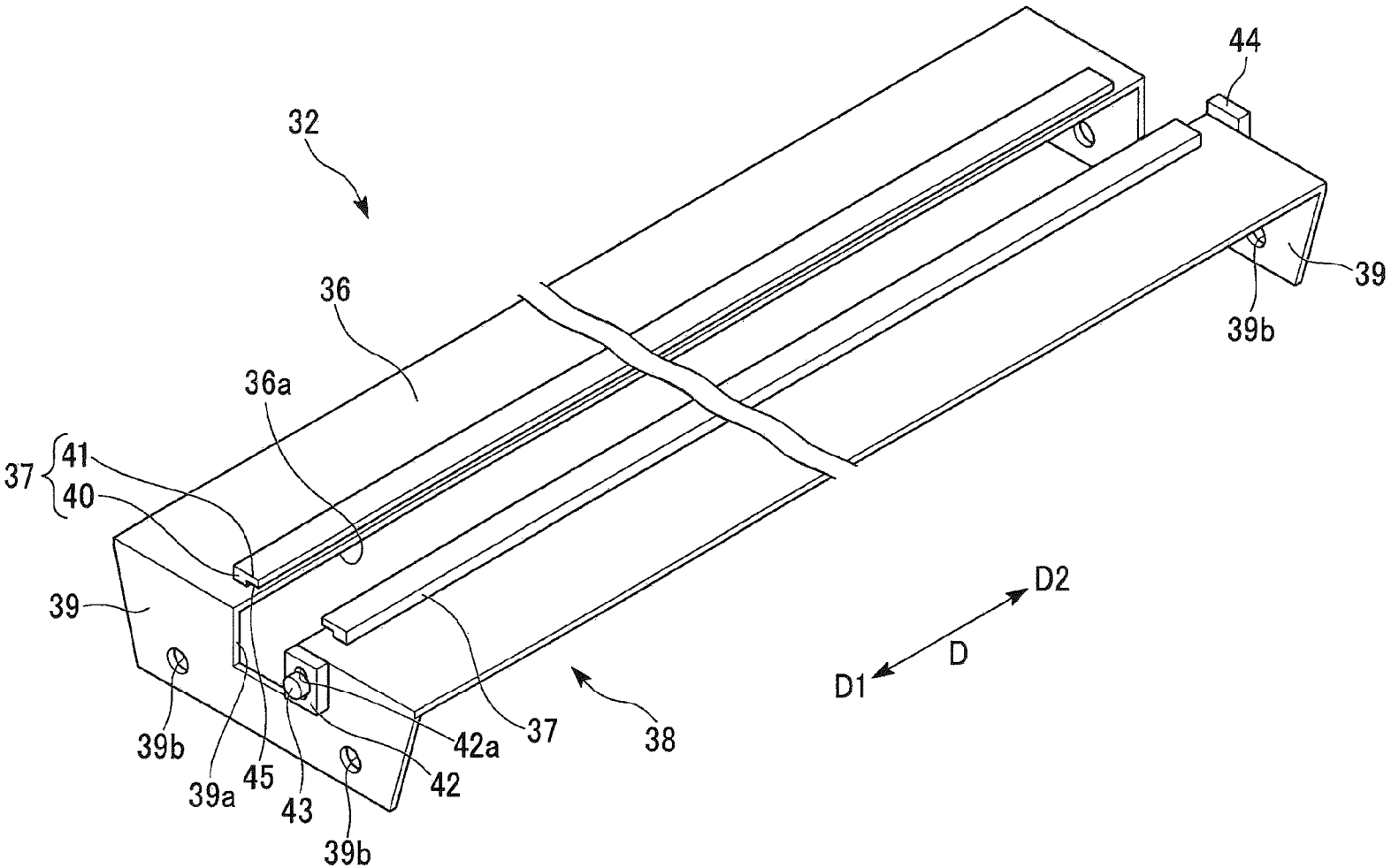
FIG. 4 is a perspective view of a mounting unit of the drum-type drying device.

As shown in FIG. 4, each of the mounting units 32 includes: a heater guide 36 that is formed in the shape of a substantially rectangular plate; a pair of insertion groove fittings 37 that is mounted on the heater guide 36; and a positioning section 38 that is connected to the heater guide 36.

Belt-like bent portions 39, which extend toward the axis C1, are formed at both ends of the heater guide 36 in the axial direction D, respectively. An insertion hole 36*a*, which extends in the axial direction D, is formed at the heater guide 36, and a cut-out portion 39*a*, which has a rectangular shape in front view, is formed at each of the heater guide 36 side of the bent portions 39. The insertion hole 36*a* and the pair of cut-out portions 39*a* communicate with each other. The above-mentioned insertion groove fittings 37 are disposed at both edge portions of the insertion hole 36*a* of the heater guide 36 in a width direction so as to be parallel to the axial direction D and face each other. As shown in FIGS. 3 and 4, each of the insertion groove fittings 37 includes: a base portion 40 that is disposed on the heater guide 36 so as to be apart from the edge portion of the insertion hole 36*a* to the outside by a predetermined distance; and a receiving portion 41 that is formed to protrude from an upper end of the base portion 40 to the edge portion of the insertion hole 36*a* so as to be substantially parallel to the heater guide 36. The base portion 40 and the receiving portion 41 are formed as a single body and extend parallel to the axial direction D. Meanwhile, groove portions (engaging portions) 45 of the invention are formed by the insertion groove fittings 37 and the edge portions of the heater guide 36. Further, a pair of groove portions 45 is disposed so as to face each other. A threaded hole (not shown) is formed at the bent portion 39 on one side D1 in the axial direction D, beside the cut-out portion 39*a*.

As shown in FIG. 4, the positioning section 38 includes: a heater unit pressing part 42 that is formed in the shape of a flat plate and provided on the bent portion 39 on one side D1 in the axial direction D; a screw member 43 that is inserted through a long hole 42*a* formed at the heater unit pressing part 42 and threadably engaged with the threaded hole of the bent portion 39 on one side D1; and a heater unit pressing part 44 that is formed in the shape of a flat plate and fixed to the bent portion 39 on the side opposite to the one side D1 in the axial direction D (hereinafter, referred to as "the other side D2" in the axial direction D of the drying drum 20). The heater unit pressing part 42 is mounted on the bent portion 39 so that a long axis of the long hole 42*a* is parallel to the thickness direction of the heater guide 36. When releasing the threaded engagement of the screw member 43, the heater unit pressing part 42 is moved along the long axis of the long hole 42*a*. Accordingly, the heater unit pressing part 42 can be moved between a locking position where one end portion of the heater unit pressing part 42 (in the thickness direction of the heater guide 36) protrudes from the upper surface of the heater guide 36 toward the insertion groove fittings 37, and a retreat position where one end portion of the heater unit pressing part 42 retreats from the upper surface of the heater guide 36 toward the cut-out portion 39*a*. When the heater unit pressing part 42 is positioned at the locking position, one end portion of the heater unit pressing part 42 is disposed so as to shield the projected range of the groove portion 45 in the axial direction D.

The heater unit pressing part 44 is fixed at the position that faces the heater unit pressing part 42 when the heater unit pressing part 44 has been moved to the locking position. A pair of mounting holes 39*b* is formed at each of the portions of the respective bent portions 39 in the direction of the axis C1 so as to be arranged in the width direction of the mounting unit 32. In this embodiment, each of the heater guides 36, the bent portions 39, the insertion groove fittings 37, and the heater unit pressing parts 42 and 44 is formed of a metal plate having a high reflectance such as a steel plate plated with Ni or Cr.

As shown in FIG. 3, the plurality of shield plates 33 is disposed around the axis C1. Each of the shield plates 33 is formed in the shape of a flat plate, and is curved in a predetermined direction when seen in the thickness direction of the plate. A plurality of mounting holes (not shown) is formed at the edge portion of the inner portion of the curved shield plate 33 at positions that correspond to the threaded holes of each of the heater supporting disks 31. Screw members 46, which are inserted through the mounting holes of the shield plates 33 and the mounting holes 39*b* of the mounting units 32, are threadably engaged with the threaded holes of the heater supporting disks 31, so that the plurality of shield plates 33 and mounting units 32 are mounted around the axis C1 as shown in FIGS. 2 and 3. Cut-out portions 33*a* to 33*c* are formed at each of the shield plates 33 so that the shield plates 33 do not overlap with the heater units 50 when seen in the axial direction D (see FIG. 3).

Figure 5:
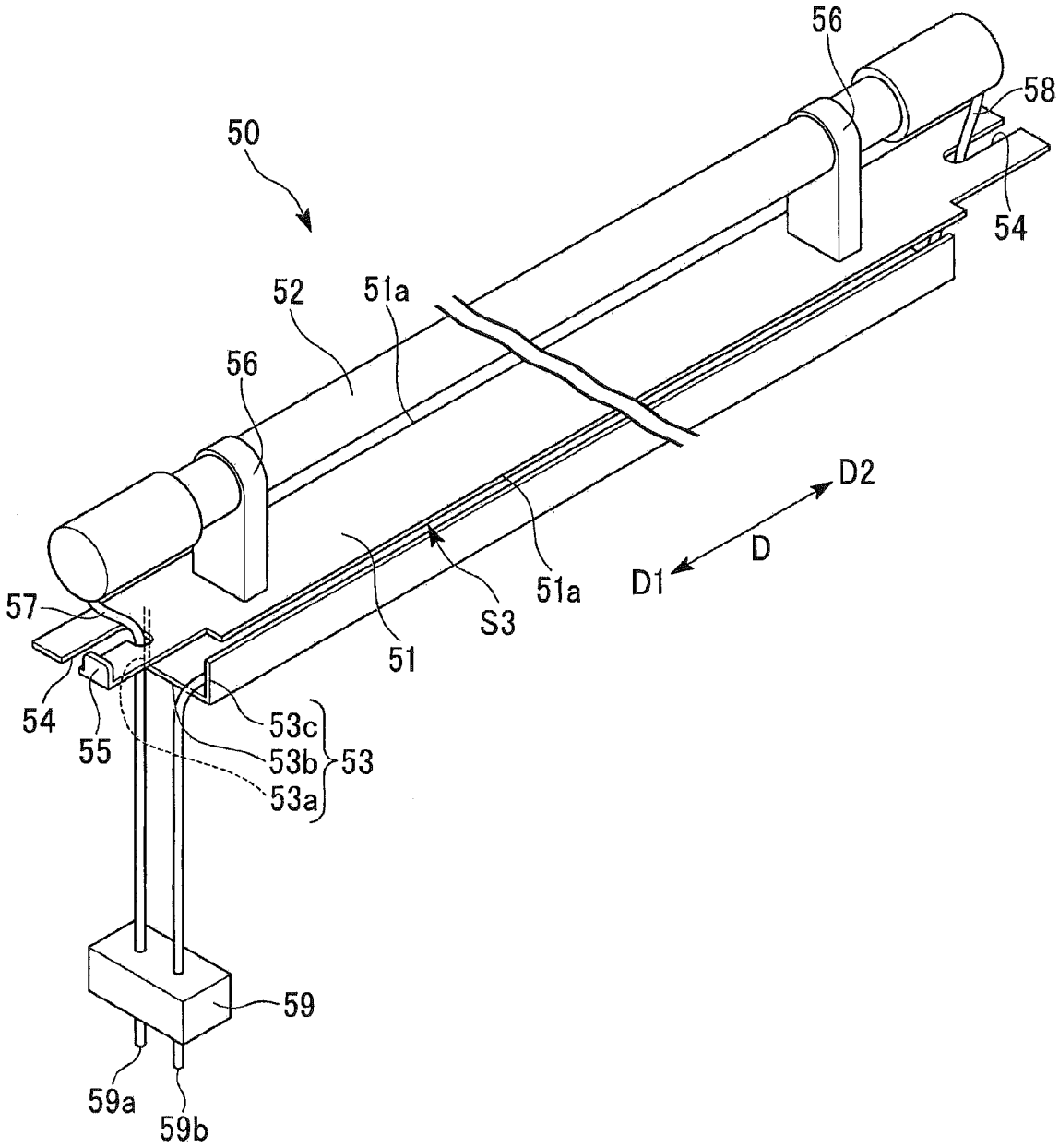
FIG. 5 is a perspective view of a heater unit of the drum-type drying device.

As shown in FIG. 5, each of the heater units 50 includes: a heater support plate (plate-like member) 51 that is formed in the shape of a substantially rectangular plate; a near-infrared heater 52 that is disposed above the heater support plate 51 so as to be apart from the heater support plate 51 by a predetermined distance; and a gutter-like lead wire support member 53 that is fixed to the side of the heater support plate 51 opposite to the near-infrared heater 52. The heater support plate 51 is formed so as to extend parallel to the axis C1. Meanwhile, both end portions 51*a* of the heater support plate 51 in a direction orthogonal to the thickness direction and the axial direction D of the heater support plate 51 correspond to engaged portions of the invention. Through grooves 54, which extend from the central portions of both ends of the heater support plate in the axial direction D, are formed at both end portions of the heater support plate 51 in the axial direction D, respectively. Further, a knob 55, which protrudes toward the near-infrared heater 52, is formed at an end portion of the heater support plate 51 on the one side D1 in the axial direction D.

The thickness of the heater support plate 51 is set to be slightly smaller than the distance between the heater guide 36 and the receiving portion 41, and the width of the heater support plate 51 is slightly smaller than the distance between the base portions 40 of the pair of insertion groove fittings 37. In addition, the length of the heater support plate 51 in the axial direction D is slightly shorter than the distance between the heater unit pressing part 42 on the one side D1 and the heater unit pressing part 44 on the other side D2.

The lead wire support member 53 includes a first guide member 53*a*, a support member 53*b*, and a second guide member 53*c*. One end portion of the first guide member 53*a* (an end portion of the first guide member 53*a* on the one side D1 in the axial direction D) is fixed to the heater support plate 51, and the other end portion of the first guide member 53*a* (an end portion of the first guide member 53*a* on the other side D2 in the axial direction D) extends in the direction separating from the heater support plate 51. The support member 53*b* extends from a tip of the first guide member 53*a* so as to be substantially parallel to the heater support plate 51. The second guide member 53*c* extends from a tip of the support member 53*b* toward the heater support plate 51. A gap S3, which extends in the axial direction D, is formed between the second guide member 53*c* and the heater support plate 51. The outer shape of the lead wire support member 53 is smaller than the inner shape of the cut-out portion 39*a* of the mounting unit 32 when seen in a direction parallel to the axis C1. The lead wire support member 53 also functions as a wiring duct having an inner cavity through which a lead wire 58 to be described below is inserted. Each of the heater support plate 51 and the lead wire support member 53 is formed of a metal plate having a high reflectance such as a steel plate plated with Ni or Cr.

The near-infrared heater 52 is a heater that generates near infrared light having a wavelength of about 0.7 to 2.5 μm. The near-infrared heater 52 is formed in the shape of a rod that extends parallel to the axial direction D, and is mounted on the heater support plate 51 at both end portions thereof by support members 56. Meanwhile, the near-infrared heater 52 can be attached to and detached from the support members 56 by a well-known mechanism. One end portions of lead wires 57 and 58 are electrically connected to both end portions of the near-infrared heater 52. The lead wire 57 of which one end is connected to the end portion of the near-infrared heater 52 on the one side D1 is inserted through the through groove 54 of the heater support plate 51 on the one side D1, and the other end of the lead wire 57 is connected to a heater-side connector 59. Meanwhile, the lead wire 58 of which one end is connected to the end portion of the near-infrared heater 52 on the other side D2 is inserted through the through groove 54 of the heater support plate 51 on the other side D2 and is inserted through the lead wire support member 53. The other end of the lead wire 58 is connected to the heater-side connector 59. Contacts 59*a* and 59*b* are formed at the heater-side connector 59 so as to protrude from the heater-side connector 59. The contacts 59*a* and 59*b* are electrically connected to the lead wires 57 and 58, respectively. As shown in FIG. 3, the contacts 59*a* and 59*b* are connected to or disconnected from the contacts 61*a* and 61*b*, so that the heater-side connectors 59 can be connected to the power source-side connectors 61. Meanwhile, the power source-side connector 61 and the heater-side connector 59 form a connection mechanism of the invention.

Both end portions 51*a* of the heater support plate 51 are engaged with the groove portions 45 of the mounting unit 32, so that each of the heater units 50 is inserted between the pair of groove portions 45. In this way, each of the heater units 50 is positioned in the radial direction and the circumferential direction of the drying drum 20. Further, both the end portions of the heater support plate 51 in the axial direction D are interposed between the heater unit pressing parts 42 and 44, so that each heater unit 50 is fixed to the mounting unit 32 while being positioned on the mounting unit 32 in the axial direction D. The heater units 50 are fixed to the plurality of mounting units 32, which is fixed to the edge portions of the pair of the heater supporting disks 31, respectively.

Next, the operation of the above-mentioned drum-type drying device 1 will be described.

First, a worker winds the base material W on the outer peripheral surface of the drying drum 20, and heats the near-infrared heaters 52 up to a predetermined temperature by supplying power to the near-infrared heaters 52 through the power supply 13. Further, the base material W is conveyed in the longitudinal direction by a conveying unit (not shown). As a result, the drying drum 20 is rotated about the axis C1 by the frictional force of the base material W. In this case, the heater units 50, the power supply cable 64, and the like are not rotated about the axis C1. In this manner, the base material W is dried by the heat of the near-infrared heaters 52 while being conveyed. Accordingly, the base material W to which printing ink or the like is applied is dried.

Next, a method of replacing the heater unit 50 of the drum-type drying device 1, for example, which is performed when the near-infrared heater 52 has a fault, will be described. Meanwhile, the near-infrared heater 52, the lead wires 57 and 58, and the heater-side connector 59 are replaced as a single body in the following embodiment.

Figure 6:
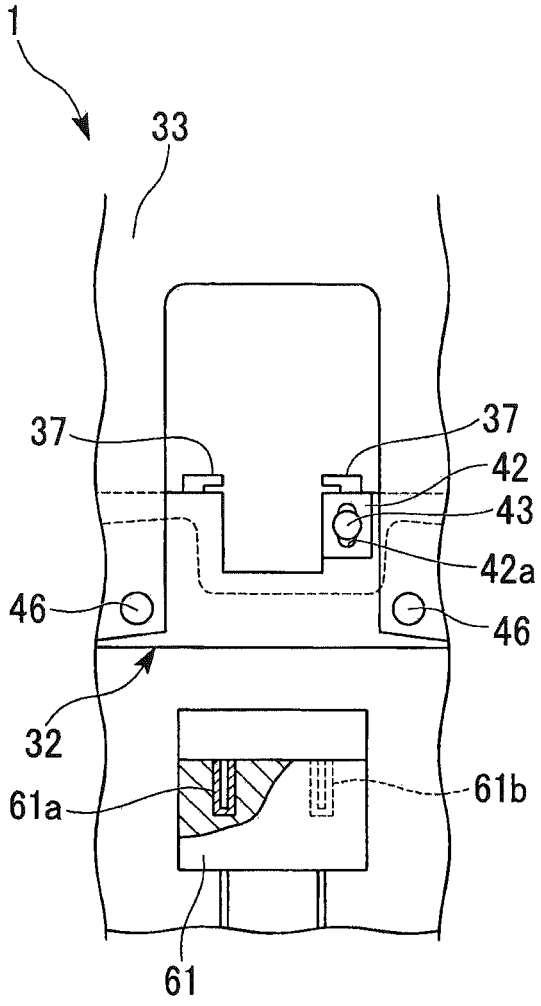
FIG. 6 is a view illustrating a method of replacing the heater unit of the drum-type drying device.

First, a worker separates the heater-side connector 59 from the power source-side connector 61. A worker inserts his or her hands into the inner cavity S1 through the large-diameter holes 24 or the small-diameter holes 25 of the drying drum 20, and releases the threaded engagement of the screw member 43, and moves the heater unit pressing part 42 from the locking position to the retreat position near the axis C1. Further, the worker holds the knob 55, pulls the heater unit 50 toward the one side D1 in the axial direction D, and separates the heater unit 50 from the mounting unit 32 as shown in FIG. 6. Meanwhile, if the heater unit pressing part 42 has been previously disposed at the retreat position or if the heater unit pressing part 42 is not provided, the heater unit pressing part 42 does not need to be necessarily moved to the retreat position from the locking position.

The worker separates the lead wire 58 from the lead wire support member 53 through the gap S3 outside the drum-type drying device 1, and replaces the near-infrared heater 52, the lead wires 57 and 58, and the heater-side connector 59 as a single body with a new part which does not have a fault. In this case, the worker disposes the lead wire 58, which is connected to a near-infrared heater 52 of the new part, in the inner cavity of the lead wire support member 53 through the gap S3. Subsequently, the worker makes the knob 55 be positioned on the front side (one side D1), inserts the heater support plate 51 between the pair of groove portions 45 until the heater support plate contacts the heater unit pressing part 44, and makes both end portions 51*a* of the heater support plate 51 be engaged with the groove portions 45 of the mounting unit 32. Further, the worker moves the heater unit pressing part 42 from the retreat position to the locking position that is positioned apart from the axis C1, tightens the screw member 43, and fixes the heater unit 50 to the mounting unit 32 while the heater unit 50 is positioned on the mounting unit 32. Furthermore, the worker connects the heater-side connector 59 to the power source-side connector 61.

Meanwhile, the near-infrared heater 52 of the heater unit 50 may be detachably and electrically connected to the lead wires 57 and 58. In this case, only the near-infrared heater 52 may be replaced without the replacement of the lead wires 57 and 58 and the heater-side connector 59 in a method of replacing the heater unit 50. That is, after taking the heater unit 50 out of the drum-type drying device 1, the worker separates the lead wires 57 and 58 from the broken near-infrared heater 52 and separates the near-infrared heater 52 from the support members 56. Further, the worker mounts a new near-infrared heater 52, which does not have a fault, on the support member 56, and connects the lead wires 57 and 58 to the near-infrared heater 52.

As described above, according to the drum-type drying device 1 of this embodiment, it may be possible to mount the heater unit 50 on the mounting unit 32 by moving the heater support plate 51 such that the end portions 51*a* of the heater support plate 51 are engaged with the groove portions 45 of the mounting unit 32. Further, it may be possible to separate the heater support plate 51 from the mounting unit 32 by moving the heater support plate 51 in a direction opposite to the direction where the heater support plate 51 is engaged with the groove portions 45 of the mounting unit 32. In this manner, it may be possible to easily attach and detach the heater unit 50 to and from the mounting unit 32 that is disposed in the inner cavity S1 of the drying drum 20. Accordingly, it may be possible to easily replace the heater unit 50.

The pair of groove portions 45, each of which is an engaging portion, is disposed so that the groove portions 45 face each other, and both end portions 51*a* of the heater support plate 51 of the heater unit 50 form engaged portions. For this reason, it may be possible to easily and reliably mount the heater unit 50 between the pair of groove portions 45 by inserting the heater support plate 51 of the heater unit 50 between the pair of groove portions 45 of the mounting unit 32.

The groove portions 45 are disposed so as to extend parallel to the axial direction D. Meanwhile, the base material W is wound on the outer peripheral surface of the drying drum 20. For this reason, it may be possible to easily attach and detach the heater unit 50 in the axial direction D where the base material W does not become a hindrance.

The mounting unit 32 includes the positioning section 38. For this reason, it may be possible to reliably hold the heater unit 50 between the pair of groove portions 45 by positioning the heater unit 50, which is guided in the axial direction D by the pair of groove portions 45, in the axial direction D and fixing the heater unit 50.

The drum-type drying device 1 according to this embodiment includes: the groove portions 45 as engaging portions; and both end portions 51*a* of the heater support plate 51 of the heater unit 50 form engaged portions. Accordingly, it may be possible to easily attach and detach the heater unit 50 to and from the mounting unit 32 with a simple structure, such as the heater support plate 51 and the pair of groove portions 45.

The drum-type drying device 1 according to this embodiment includes: the connection mechanism, which includes the power source-side connectors 61 and the heater-side connectors 59; and the power supply 13. When power is supplied to the heater units 50 from the power supply 13, it may be possible to easily switch the electrical connection and disconnection between the power supply 13 and the heater units 50 by the connection mechanism.

The large-diameter holes 24 and the small-diameter holes 25 are formed at each of the pair of lids 22. For this reason, it may be possible to easily attach and detach the heater units 50 to and from the mounting units 32 through the large-diameter holes 24 and the small-diameter holes 25.

The drum-type drying device 1 according to this embodiment includes: the drum shaft 10 that is formed in a tubular shape; and the power supply cables 64 that are led to the outside of the drying drum 20 from the inner cavity S1 of the drying drum 20 through the inner cavity S2 of the drum shaft 10. For this reason, it may be possible to protect the power supply cables 64 from the drying drum 20, which is rotated about the axis C1, by the drum shaft 10.

Each of the heater units 50 includes the near-infrared heater 52. For this reason, heat generated from the near-infrared heaters 52 is apt to be transferred through the inner peripheral surface of the drum main body 21 of the drying drum 20 and is apt to reach even the middle portion of the drum main body 21 in the thickness direction of the drum main body, the outer peripheral surface of the drum main body 21, or the like. That is, it may be possible to effectively heat and dry the base material W that is wound on the outer peripheral surface of the drum main body 21.

The drum-type drying device 1 according to this embodiment includes: the shield plates 33; and the heater support plates 51 having a high reflectance. For this reason, it may be possible to effectively heat the inner peripheral surface of the drying drum 20 with the heat that is generated from the near-infrared heaters 52.

A heat source, which heats the inner peripheral surface of the drying drum 20, is formed of the plurality of heater units 50. For this reason, when some heater units 50 have a fault, only the faulty heater units 50 may be replaced. Accordingly, it may be possible to reduce costs necessary for the maintenance of the drum-type drying device 1.

The gap S3, which extends in the axial direction D, is formed at the lead wire support member 53 of the heater unit 50. For this reason, it may be possible to dispose the lead wire 58, which is connected to the near-infrared heater 52, in the inner cavity of the lead wire support member 53 through the gap S3, and to collect the end portions of the lead wires 57 and 58 on one side D1 of the heater unit 50 in the axial direction D. That is, it may be possible to easily replace the heater unit 50.

(Second Embodiment)

Figure 7:
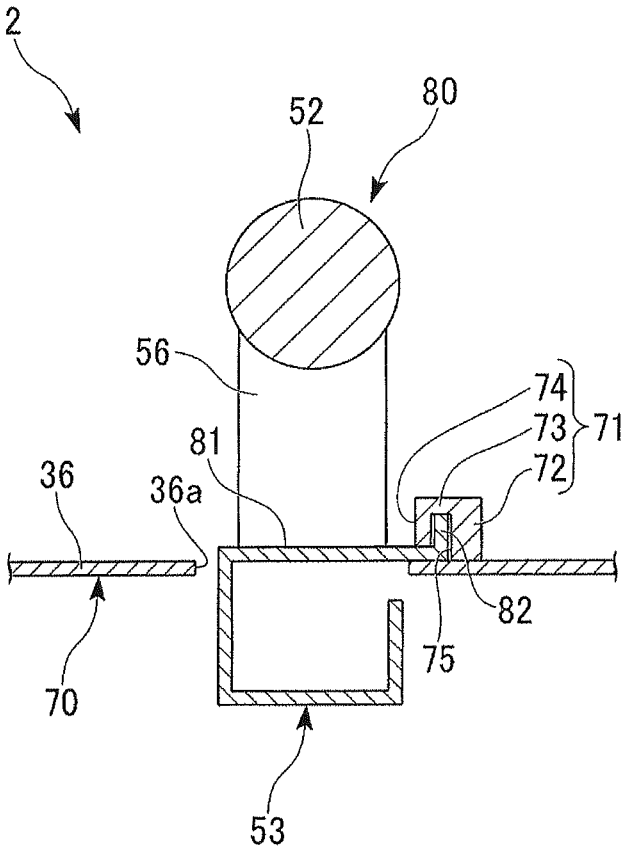
FIG. 7 is a cross-sectional view of main parts of a drum-type drying device according to a second embodiment of the invention.

Next, a second embodiment of the invention will be described with reference to FIG. 7. The same parts as those of the first embodiment are denoted by the same reference numerals, and the description thereof will be omitted. Only the differences between the first and second embodiments will be described. As shown in FIG. 7, a drum-type drying device 2 according to this embodiment includes mounting units 70 instead of the mounting units 32 of the drum-type drying device 1 according to the first embodiment and heater units 80 instead of the heater units 50.

Each of the mounting units 70 includes an insertion groove fitting 71 instead of the pair of insertion groove fittings 37 of the mounting unit 32. The insertion groove fitting 71 is disposed at one edge portion of the insertion hole 36*a* of the heater guide 36 in a width direction. The insertion groove fitting 71 includes: a pillar-like base portion 72; a first receiving portion 73; and a second receiving portion 74. The pillar-like base portion 72 is disposed on the heater guide 36 so as to be apart from an edge portion of the insertion hole 36*a* by a predetermined distance. The first receiving portion 73 protrudes substantially parallel to the heater guide 36 from the surface of the tip of the base portion 72 facing the insertion hole 36*a*. The second receiving portion 74 protrudes substantially parallel to the base portion 72 from the tip of the first receiving portion 73 with a predetermined gap between the base portion 72 and itself. A gap is formed between the tip of the second receiving portion 74 and the heater guide 36. The base portion 72, the first receiving portion 73, and the second receiving portion 74 are formed as a single body and extend parallel to the axial direction D. Meanwhile, a groove portion 75 of the invention is formed by the insertion groove fitting 71 and the edge portion of the heater guide 36.

Each of the heater units 80 includes a heater support plate 81 instead of the heater support plate 51 of the heater unit 50. The heater support plate 81 is formed in the shape of a substantially rectangular plate, and a bent portion (engaged portion) 82, which extends in the direction separating from the axis C1, is formed at an end portion of the heater support plate 81 where the insertion groove fitting 71 is disposed. The thickness of the heater support plate 81 is set to be slightly smaller than the gap between the heater guide 36 and the tip of the second receiving portion 74. The thickness of the bent portion 82 is set to be slightly smaller than the gap between the base portion 72 and the second receiving portion 74. The bent portion 82 of the heater support plate 81 is inserted through the groove portion 75 of the mounting unit 70 so as to be engaged with the groove portion 75, so that the heater unit 80 is positioned in the radial direction and the circumferential direction of the drying drum 20.

According to the drum-type drying device 2 of this embodiment, it may be possible to easily attach and detach the heater unit 80. In particular, in this embodiment, one insertion groove fitting 71 may be provided at the mounting unit 70 and one bent portion 82 may be formed at the heater unit 80. For this reason, for example, even in the case where another element is disposed at one edge portion of the heater guide 36 in the width direction of the heater guide 36, it may be possible to use the structure of this embodiment.

The first and second embodiments of the invention have been described in detail above with reference to the drawings. However, the specific structure is not limited to the embodiments, and the invention also includes modifications within the scope of the invention.

Figure 8:
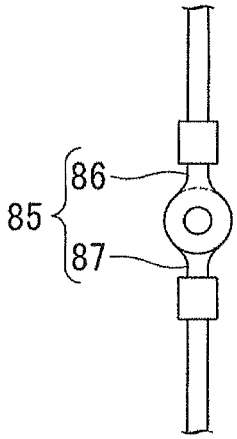
FIG. 8 is a view showing a connection mechanism of a drum-type drying device according to a modification of the invention.

For example, in the first and second embodiments, the connection mechanism of the invention is formed of the power source-side connector 61 and the heater-side connector 59. However, like a connection mechanism 85 shown in FIG. 8, the connection mechanism 85 may be formed of a pair of connecting terminals 86 and 87, such as Y-type or O-type terminals, and a screw member (not shown) that holds the terminals 86 and 87 while connecting the terminal 86 to the terminal 87. According to this structure, it may be possible to more simply form the connection mechanism.

Further, two end portions 51*a* are formed at the heater unit 50 as the engaged portions in the first embodiment and one bent portion 82 is formed at the heater unit 70 as the engaged portion in the second embodiment. Furthermore, the engaging portions of which the number corresponds to the engaged portions are formed at the mounting unit. However, the number of the engaged portions formed at the heater unit is not limited, and the number of the engaged portions may be arbitrary as long as one or more engaged portions are formed.

Further, in the first and second embodiments, the large-diameter holes 24 and the small-diameter holes 25 are formed at each of the pair of lids 22. However, the large-diameter holes 24 and the small-diameter holes 25 may be formed at least one of the pair of lids 22. The number of through holes such as the large-diameter holes 24, which are formed at the lid 22, and the size of the through hole may be appropriately set according to an operation.

Furthermore, in the first and second embodiments, the groove portion of the mounting unit is formed to extend parallel to the axial direction D. However, as long as there is no hindrance to the attachment and detachment of the heater unit, the groove portion may be formed so as to extend and be inclined at an acute angle with respect to the axial direction D.

Moreover, the positioning section 38 is not an essential component in the first and second embodiments. However, it is preferable that the positioning section 38 be provided if the engaged portion of the heater unit is easily moved in the axial direction D in the engaging portion of the mounting unit.

Further, in the first and second embodiments, the heater unit includes the near-infrared heater 52. However, the heater used in the heater unit is not limited to the near-infrared heater, and an infrared heater such as a far-infrared heater or a sheet heating element such as a sheet heater may be appropriately used in the heater unit.

What is claimed is:

1. A drum-type drying device comprising:

a cylindrical drum section that is rotatably supported and rotated by winding a base material on the drum section;

a tubular member that supports the drum section so as to allow the drum section to be rotatable about the axis of the drum section;

a pair of heater supporting plates each of which is disposed, in an inner cavity of the drum section, apart from the other, the pair of heater supporting plates extending parallel to a direction orthogonal to the axis of the tubular member and being fixed to the tubular member;

a mounting unit which extends parallel to the axial direction of the tubular member and is fixed to edge portions of the pair of heater supporting plates, the mounting unit comprising: a plate-like heater guide that has first and second bent portions formed by bending both ends of the heater guide in the axial direction of the tubular member so that the first and second bent portions extend parallel to the direction orthogonal to the axis of the tubular member;

engaging portions that are disposed in the inner cavity of the drum section, that are fixed to the tubular member, and that are a pair of groove portions that is formed on the heater guide so as to extend parallel to the axial direction of the tubular member; and a heating section that comprises:

a heater;

a plate-like member which supports the heater; and engaged portions that are detachably engaged with the engaging portions, and that are formed in end portions of the plate-like member so that the end portions of the plate-like member are detachably engaged with the pair of groove portions, respectively;

wherein the mounting unit further comprises a positioning section that positions the heating section in the axial direction of the tubular member and fixes the heating section, the positioning section comprising:

a first heater unit pressing part that is provided on the first bent portion of the heater guide; and a second heater unit pressing part that is provided on the second bent portion of the heater guide;

the first heater unit pressing part is capable of being moved between a locking position where one end portion of the first heater unit pressing part protrudes from an upper surface of the heater guide, and a retreat position where the one end portion of the first heater unit pressing part is under the upper surface of the heater guide; and when the first heater unit pressing part is at the locking position, the heating section is positioned in the axial direction of the tubular member and is fixed by the first heater unit pressing part and the second heater unit pressing part coming into contact with the heating section to restrict the movement of the heating section in the axial direction of the tubular member.

2. The drum-type drying device according to claim 1, further comprising:

a power supply that supplies power to the heating section; and a connection mechanism by which the heating section and the power supply are detachably and electrically connected to each other.

3. The drum-type drying device according to claim 1, wherein through holes, which communicate with an inner cavity of the drum section, are formed in at least one surface of an axial direction side of the drum section.

4. The drum-type drying device according to claim 2, further comprising:

power supply cables that electrically connect the connection mechanism to the power supply, wherein the power supply cables are led to the outside of the drum section from the inner cavity of the drum section through an inner cavity of the tubular member.

5. The drum-type drying device according to claim 1, wherein the heater is a near-infrared heater.

6. The drum-type drying device according to claim 1, wherein the drum section includes: a tubular drum main body; and a pair of disk-shaped lids that are disposed so as to close openings formed at both end portions of the drum main body.

7. The drum-type drying device according to claim 2, wherein:

the connection mechanism is formed of a pair of connectors that are provided on only one side in the axial direction of the drum section, and that are detachably connected to each other; and there are further provided: a first lead wire that has one end electrically connected to the heating section and the other end drawn to the one side in the axial direction of the drum section and electrically connected to one of the pair of connectors; and a second lead wire that has one end electrically connected to the heating section and the other end drawn to the one side in the axial direction of the drum section and electrically connected to the other of the pair of connectors.

* * * * *